US011980923B2

(12) United States Patent
Grosse Lordemann et al.

(10) Patent No.: US 11,980,923 B2
(45) Date of Patent: May 14, 2024

(54) COOLING DEVICE AND METHOD FOR OPERATING THE SAME

(71) Applicant: SMS GROUP GMBH, Duesseldorf (DE)

(72) Inventors: Frederik Grosse Lordemann, Duesseldorf (DE); Frank Werner, Duesseldorf (DE)

(73) Assignee: SMS GROUP GMBH, Duesseldorf (DE)

( * ) Notice: Subject to any disclaimer, the term of this patent is extended or adjusted under 35 U.S.C. 154(b) by 875 days.

(21) Appl. No.: 17/046,845

(22) PCT Filed: Apr. 4, 2019

(86) PCT No.: PCT/EP2019/058451
§ 371 (c)(1),
(2) Date: Nov. 13, 2020

(87) PCT Pub. No.: WO2019/197254
PCT Pub. Date: Oct. 17, 2019

(65) Prior Publication Data

US 2021/0316348 A1 Oct. 14, 2021

(30) Foreign Application Priority Data

Apr. 13, 2018 (DE) ..... 102018205684.6

(51) Int. Cl.
*B21B 45/02* (2006.01)
*C21D 1/62* (2006.01)
*C21D 11/00* (2006.01)

(52) U.S. Cl.
CPC ..... *B21B 45/0215* (2013.01); *C21D 1/62* (2013.01); *C21D 11/005* (2013.01)

(58) Field of Classification Search
None
See application file for complete search history.

(56) References Cited

U.S. PATENT DOCUMENTS

2021/0162478 A1* 6/2021 Sprock ..... C21D 1/62
2021/0316348 A1* 10/2021 Grosse Lordemann . C21D 1/62

FOREIGN PATENT DOCUMENTS

EP 2155411 A1 4/2008
EP 2155411 B1 2/2010
(Continued)

*Primary Examiner* — Scott R Kastler
(74) *Attorney, Agent, or Firm* — Amster, Rothstein & Ebenstein LLP

(57) ABSTRACT

A cooling device for cooling a metallic product has at least one cooling bar with a plurality of spraying regions which are adjacent in pairs defined by one or more moveable partition walls. Each spraying region has at least one spray nozzle for spraying a coolant onto the metallic product. A control device controls a pump and valves for individually adjusting pressure and/or volume flow of the coolant in each of the spraying regions. The one or more partition walls divide the interior of the cooling bar into at least two chambers, each of the spraying regions being assigned to a different one of the chambers. The partition wall is shaped at least approximately in accordance with a temperature distribution along a width section of the metallic product before it enters the cooling device. The partition wall is arranged in the cooling bar over this width section.

20 Claims, 4 Drawing Sheets

(56) References Cited

FOREIGN PATENT DOCUMENTS

| | | | |
|---|---|---|---|
| EP | 2986400 | B1 | 2/2016 |
| EP | 3385008 | A1 | 10/2018 |
| JP | 59041426 | A | 3/1984 |
| JP | 2008194712 | A | 8/2008 |
| JP | 2011167754 | A | 1/2011 |

* cited by examiner

COOLING DEVICE AND METHOD FOR OPERATING THE SAME

CROSS REFERENCE TO RELATED APPLICATIONS

This application is a national phase of PCT application No. PCT/EP2019/058451, filed Apr. 4, 2019, which claims priority to DE patent application No. 102018205684.6, filed Apr. 13, 2018, all of which are incorporated herein by reference thereto.

FIELD OF THE INVENTION

The invention relates to a cooling device for cooling a metallic product, in particular a metal strip. The invention also relates to a method for operating a corresponding cooling device.

BACKGROUND OF THE INVENTION

Cooling devices of this type are well known in the prior art, for example from European patents EP 2 155 411 B1 and EP 2 986 400 B1.

European patent EP 2 155 411 B1 discloses a cooling device for influencing the temperature distribution over the width of a metallic product, in particular a rolled product. The cooling device has nozzles for applying a coolant to the metallic product, the nozzles being arranged distributed over the width. At least one of the nozzles can be adjusted in its position with regard to the width of the metallic product. This enables influencing non-uniform temperature distributions over the width of the metal strip to a limited extent. A subdivision of the cooling bar into individual spraying regions is not known from this patent.

The division of a cooling bar into individual spraying regions is known, for example, from European patent EP 2 986 400 B1. Specifically, the cooling device disclosed therein has at least one cooling bar which extends transversely to the transport direction of the metallic product when passing through the cooling device. The at least one cooling bar has—in its longitudinal direction, that is, transversely to the transport direction of the metallic product—two outer spraying regions and one central spraying region arranged between the two outer spraying regions. A coolant can be fed into each of the spraying regions via specially assigned individually controllable valves, which coolant is then applied to the metallic product to be cooled via the spray nozzles assigned to the respective spraying region.

SUMMARY

The invention is based on the object of further developing a known cooling device and a known method for its operation so that application of coolant to the metallic product is improved and the starting point of a degressive decrease or a positive increase of the volume flow of the coolant along the longitudinal extent of the cooling bar can be variably set.

This and other objectives are achieved by the subject matter as set forth below in the claims. Accordingly, at least one partition wall is provided in the at least one cooling bar of the cooling device according to the invention for dividing the interior of the cooling bar into at least two chambers, each of the spraying regions being assigned to a different one of the chambers. The partition wall is shaped at least approximately in accordance with the course of the temperature distribution in a predetermined width section of the metallic product before it enters the cooling device, and the partition wall is arranged in the cooling bar above this width section. The cooling device further includes at least one control element also controllable by the control device for the variable positioning of the partition walls within the cooling bar, in particular for moving the partition walls in the longitudinal direction of the cooling bar, and thus for changing the chambers and the spraying regions of a respective one of the cooling bars.

The claimed division of the interior of the cooling bar into a plurality of chambers with partition walls and in particular the claimed special shape of the partition walls according to the course of the temperature distribution over the width of the product to be cooled advantageously enables particularly effective and targeted cooling of the product. In particular, as a result of the claimed shape of the partition walls, preferably in connection with a different supply of coolant into the chambers separated by the partition wall, the cooling can be adapted particularly well to the actual cooling requirement across the width of the product. In this way, constant, degressive or progressive cooling strategies can advantageously be implemented over the width of the product to be cooled.

Due to this claimed movability of the partition wall elements, in particular the starting point of a degressive decrease or a positive increase in the volume flow of the coolant along the longitudinal extent of the cooling bar can be variably set and suitably adapted to cooling requirements at hand in each individual case. The starting point can be adjusted symmetrically on both sides with respect to the width of the product to be cooled or alternatively also asymmetrically on only one side of the product to be cooled, depending on the temperature profile of the metallic product entering the cooling device.

When, according to a first exemplary embodiment, at least one of the spraying regions has a plurality of spray nozzles distributed over the surface area of the spraying region, preferably arranged in parallel rows running in the longitudinal direction of the cooling bar, this offers the advantage that relatively smooth arcuate or curved distributions of coolant discharge are also possible over the width of the product to be cooled are possible, i.e., without excessive jumps or discontinuities in the transition between individual subsections of the distribution.

In relation to the center of the metallic product to be cooled, it can be advantageous to choose a symmetrical or asymmetrical arrangement and/or number of spray nozzles in the spraying regions, depending on the temperature profile of the product entering the cooling device, with the temperature profile being modified in a suitable manner.

Advantageously, at least three chambers are formed in a cooling bar, i.e., a left, central and right spraying region, because the edge regions of the product to be cooled generally require less cooling than the central region of the product.

The cooling device can have a plurality of cooling bars arranged in parallel, which are each arranged above or below the product to be cooled. Such a group-wise combination of several cooling bars offers the advantage that the distribution of the coolant over the width of the product can be realized even more smoothly, i.e., without jumps or pronounced kinks in the volume flow of the coolant.

The control device can be designed either in the form of a pilot control or in the form of a closed loop controller. In both cases, the control device is used to achieve a pre-calculated target distribution of the coolant across the width of the metallic product. In both cases, the respectively desired target distribution of the coolant over the product to be cooled can be achieved via the volume flow or the pressure of the coolant by appropriately adjusting the valves or via positioning of the partition walls with the actuators. The target distributions of the volume flow or the pressure of the coolant over the width of the product to be cooled are preferably calculated using a cooling model. This applies both to the control device being designed in the form of a pilot control as well as in the form of a closed loop controller.

The above-mentioned object of the invention is further achieved by a method as described and claimed in detail below. The advantages of this method correspond to the advantages mentioned above with regard to the claimed device.

The partition walls can be moved outside or during an ongoing cooling operation.

Further advantageous configurations of the cooling device according to the invention and of the method for its operation according to the invention are the subject of the claims as set forth below.

BRIEF DESCRIPTION OF THE DRAWINGS

The description is accompanied by a total of five Figures, of which.

The invention is described in detail below with reference to the Figures in the form of exemplary embodiments. In all figures, the same technical elements are denoted by the same reference symbols.

DETAILED DESCRIPTION OF THE EMBODIMENTS

Figure 1:
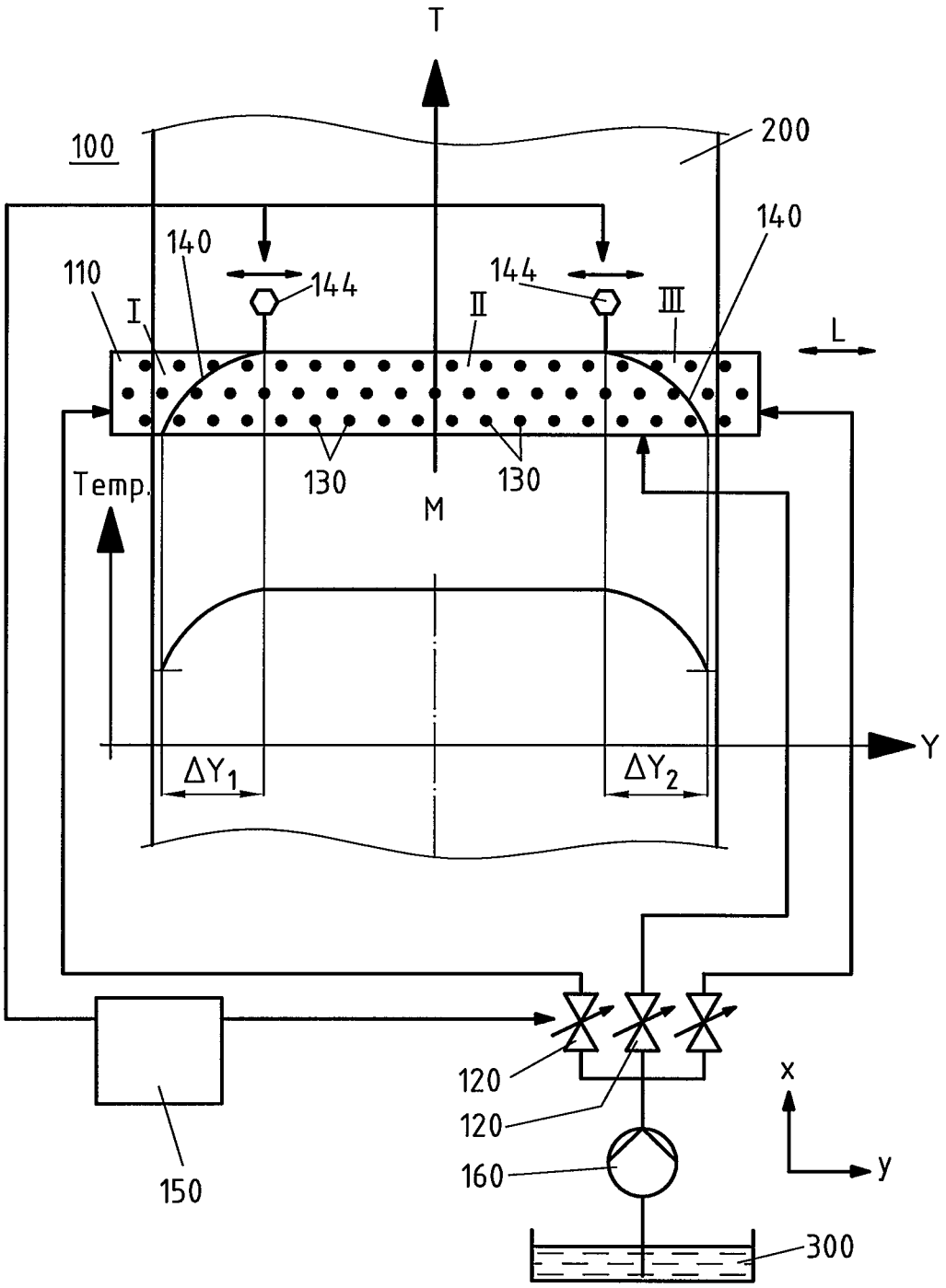
FIG. 1 shows the cooling device according to the invention with a first exemplary embodiment for the shape of the partition walls.

FIG. 1 shows the cooling device 100 according to the invention for cooling a metallic product 200. The metallic product 200 passes through the cooling device 100 in the material flow direction x or in the transport direction T of the product. According to FIG. 1, the cooling device 100 includes, for example, a cooling bar 110 with a plurality, here for example N=3, of spraying regions I, II, III that are adjacent in pairs. Each of the spraying regions has at least one spray nozzle 130 for spraying a coolant onto the metallic product 200. In FIG. 1, each of the spraying regions I, II, III has a plurality of spray nozzles which are arranged distributed in the X and Y directions. By way of example and preferably, the spray nozzles 130 are each arranged so as to run in parallel rows in the longitudinal direction L of the cooling bar 110. According to the invention, the interior of the cooling bar 110 is divided into a plurality of chambers by partition walls 140. The partition walls can be arranged in a stationary or displaceable manner within the cooling bar. Each of these chambers is assigned one of the spraying regions I, II, III.

FIG. 1 further exemplarily shows three valves 120 for individually setting the pressure or the volume flow of the coolant in each of the spraying regions I, II, III. The coolant 300 is fed individually from a coolant tank with the aid of a pump 160 through the valves 120 into the individual spraying regions I, II, III. Finally, a control device 150 is provided for the individual control of the pump 160 and the valves 120.

FIG. 1, exemplarily shows two partition walls 140 for dividing the cooling bar 110 into three chambers or three spraying regions I, II, III. The three regions are symmetrical in relation to the center M of the metallic product; this means that an equal number of spray nozzles is allocated to the middle spraying region II to the right and left of the center.

FIG. 1 further shows the temperature distribution of the product, typically measured with a temperature-measuring device, over the width of the product prior to entering the cooling device or prior to moving under the cooling bar 110. According to the present invention, in a width section $\Delta Y1$, $\Delta Y2$, the partition walls are formed corresponding to the temperature profile over the same width portion $\Delta Y1$, $\Delta Y2$.

Figure 2:
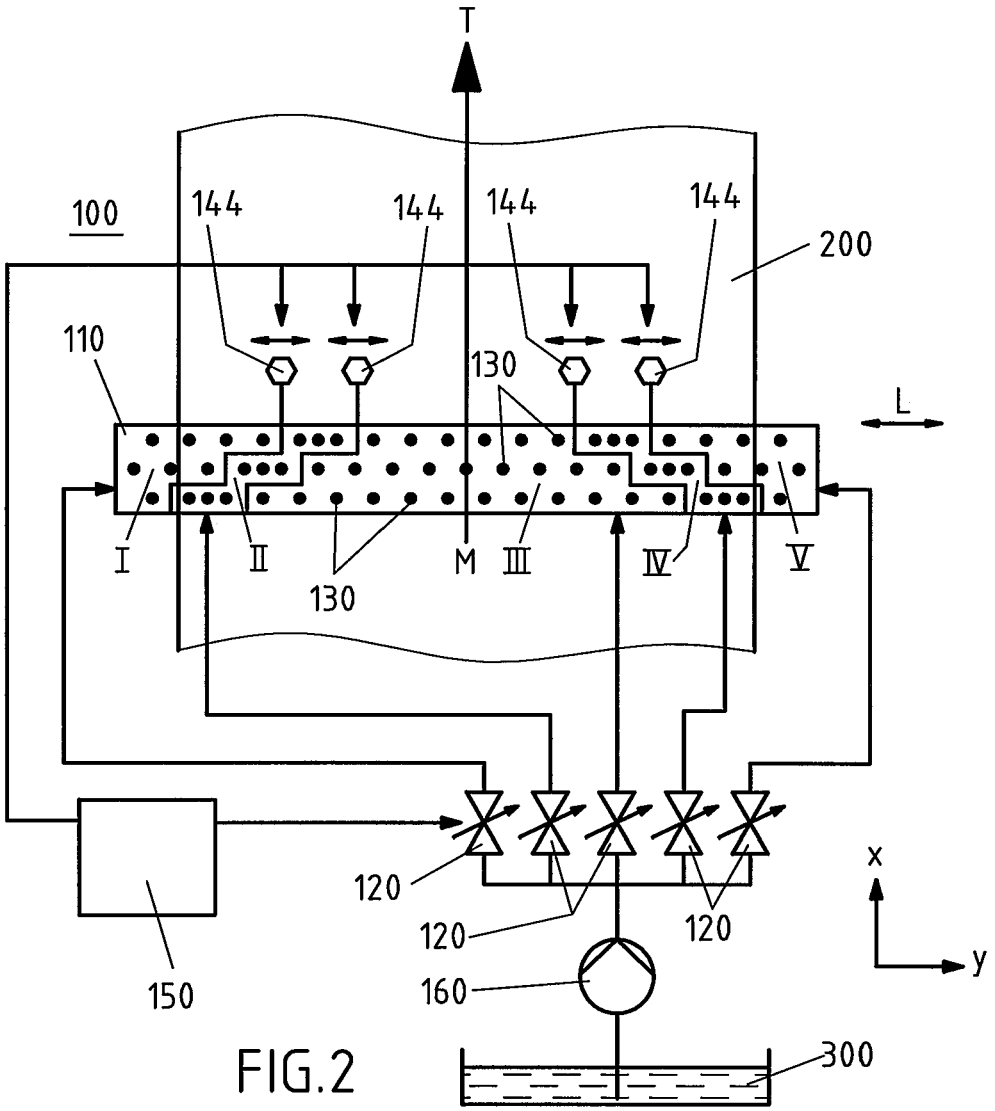
FIG. 2 shows the cooling device according to the invention with a second exemplary embodiment for the shape and arrangement of the partition walls.

In contrast, FIG. 2 shows a second embodiment for dividing the cooling bar 110 into individual chambers and spraying regions, here five spraying regions I, II, III, IV and V. Accordingly, five valves 120 are provided for individually feeding the coolant 300 into the individual chambers or spraying regions. In contrast to the first exemplary embodiment according to FIG. 1, in the second exemplary embodiment shown in FIG. 2, the arrangement or the number of spray nozzles 130 is asymmetrical with respect to the center M of the metallic product. This can be seen in particular from the fact that more spray nozzles 130 are arranged in the right half of the middle spraying region III than in its left part.

In the exemplary embodiments shown in FIGS. 1 and 2, the partition walls 140 each extend between the spray nozzles 130. In both exemplary embodiments, the partition walls are step-shaped; alternatively, however, they can also be designed to extend straight or arcuate, in particular parabolic. As mentioned, ideally, the partition walls are shaped exactly in accordance with the temperature distribution in a corresponding width section. In practice, it is often sufficient to approximate the shape of the partition walls to the temperature distribution, for example by means of the step function or a straight line. The number of chambers or spraying regions per cooling bar is generally arbitrary. The more chambers or spraying regions are employed, the more precisely a desired distribution for the coolant over the width of the product can be set.

According to a variant, the control device can be designed in the form of a pilot control for suitable setting of the valves 120 and/or the actuators 144 for positioning the partition walls with regard to setpoint values, in particular a calculated or predetermined setpoint distribution for the coolant 300 over the metallic product.

Alternatively, the control device 150 can also be designed in the form of a closed loop controller for regulating an actual distribution of the volume flow of the coolant to a predetermined target distribution of the coolant over the metallic product by variable control of the valves 120 and/or the actuating elements 144 for the positioning of the partition walls 140. The valves 120 and/or the actuating elements 144 then represent the actuators of the control loop.

Figure 3:
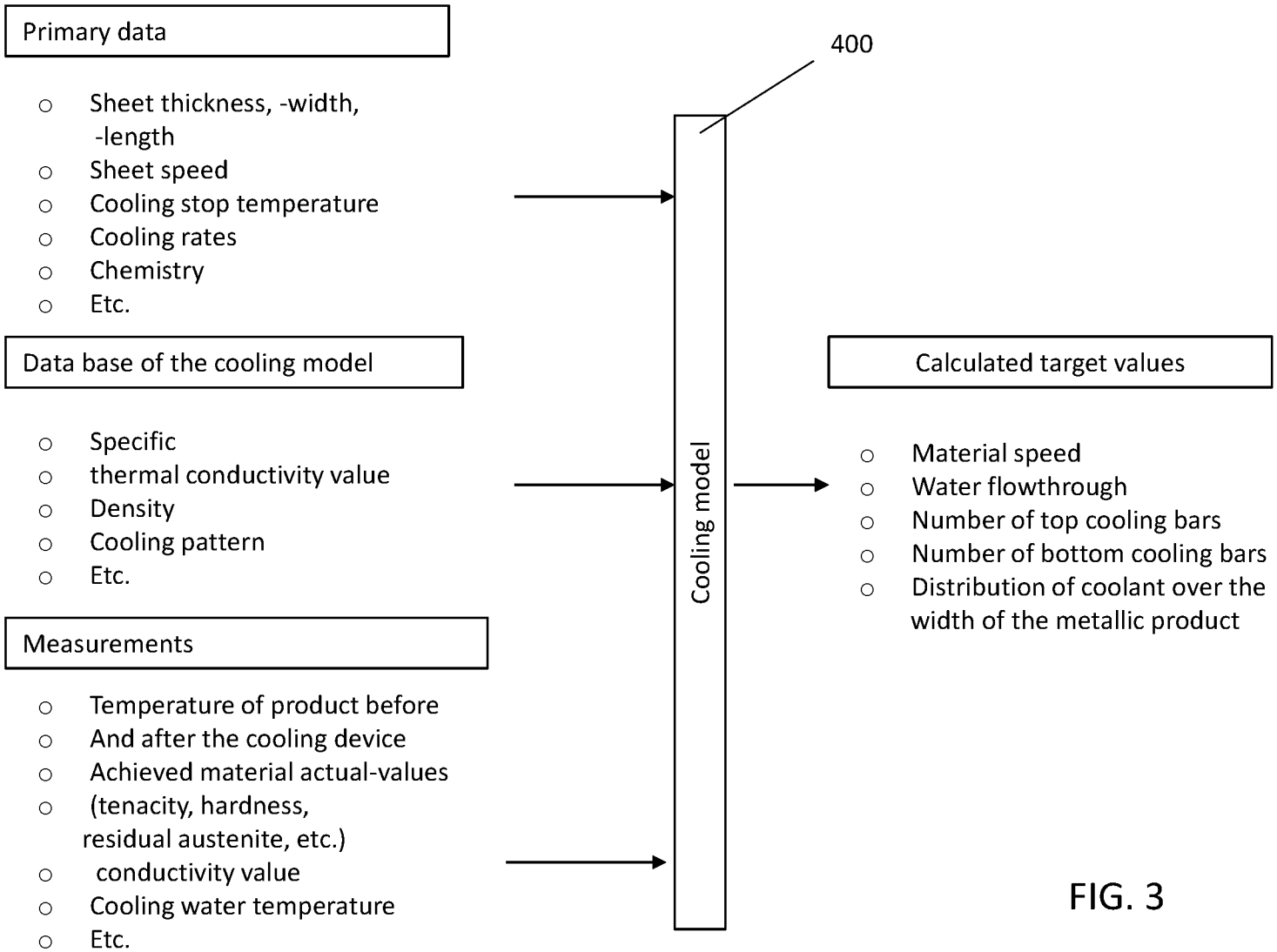
FIG. 3 shows an example of the cooling model according to the invention.

To calculate the distribution of the coolant over the metallic product, in particular over its width, as setpoint values for the pilot control or the closed loop controller, it is advantageous to use a cooling model, as shown by way of example in FIG. 3.

The cooling model is a computer program which, on the basis of the primary data mentioned in FIG. 3, the data available in a database of the cooling model and on the basis of measurements, as mentioned by way of example in FIG. 3, calculates different setpoint values, in particular the target-distribution of the coolant across the width of the metallic product to be cooled. All of the individual data or parameters or setpoint values mentioned in FIG. 3 are merely exemplary. This means that it is not absolutely necessary for the calculation of certain setpoint values to always use all of the exemplary input variables on the input side of the cooling model.

Figure 4:
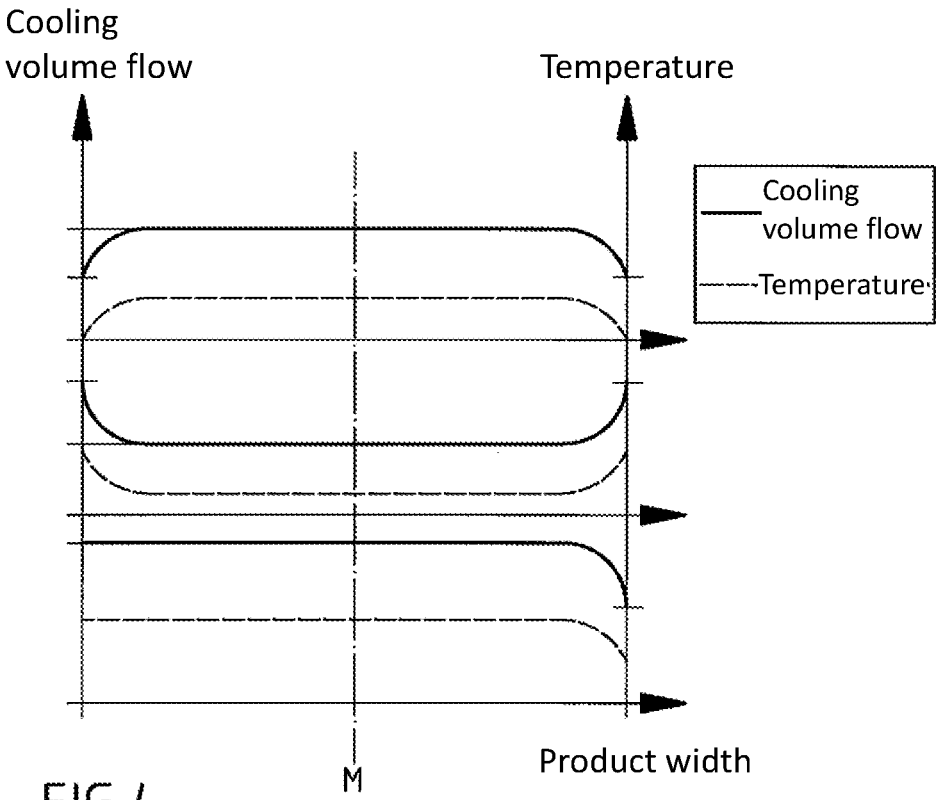
FIG. 4 shows various examples for the implementation of the volume flow of the coolant over the width of the product to be cooled as a function of the temperature distribution of the product entering the cooling device.

FIG. 4 shows a selection of different temperature profiles over the width of the product to be cooled prior to entering the cooling device 100 according to the invention, with a qualitative representation of exemplary useful cooling strategies. The dashed curve designates the temperature profile of the metallic product before entering the cooling device. The solid line shown thereabove is characteristic of the distribution according to the invention of the coolant within the cooling device for treating the incoming temperature profile.

For example, in the top illustration of FIG. 4 it can be seen that the edges of the incoming metallic product are less heated than its center, and accordingly the coolant volume flow at the edges needs to be less pronounced than in the center. Conversely, the center illustration in FIG. 4 shows an example where the edges are more heated than the center. Accordingly, the coolant flow must be increased at the edges in order to achieve a uniform cooling profile over the entire width of the product. While the top and center illustrations in FIG. 4 require a symmetrical distribution of the coolant, which goes hand in hand with a symmetrical division of the spraying regions over the length of the cooling bar and a symmetrical arrangement of the spray nozzles and preferably also a symmetrical arrangement of the spray nozzles within the spraying regions, the bottom illustration in FIG. 4 shows an asymmetrical temperature and coolant curve. Specifically, it can be seen that the temperature at the left edge region is the same as at the center of the product, while the temperature in the right edge region has dropped significantly. Accordingly, the coolant distribution required in this case in the left edge region must be almost constant or unchanged compared to the central region of the product to be cooled, while the output of the coolant volume flow at the right edge must be significantly reduced.

Figure 5:
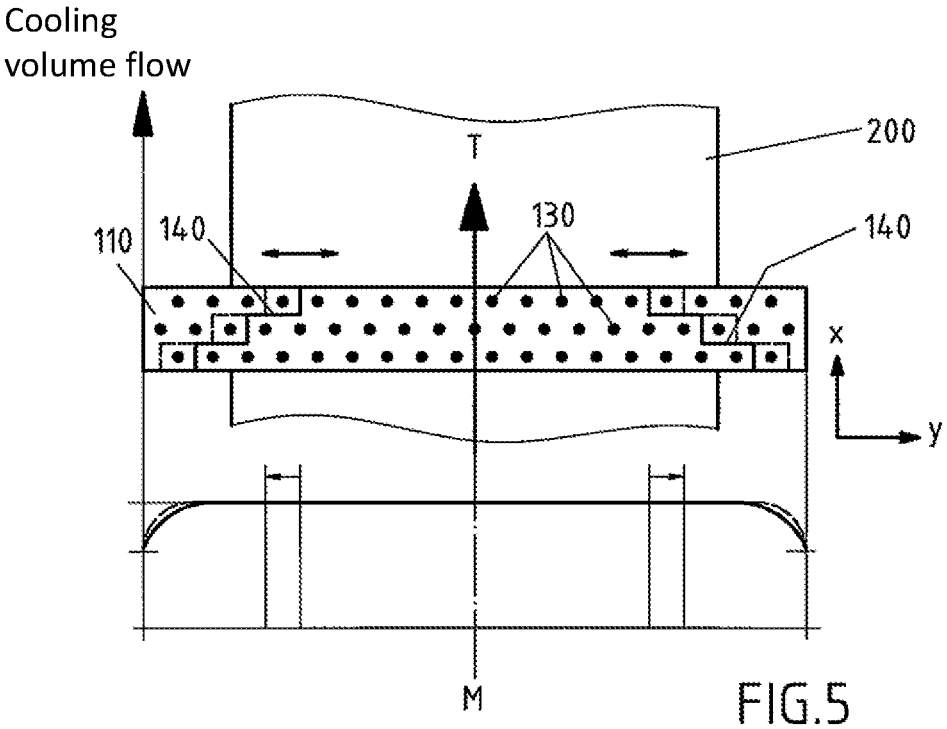
FIG. 5 shows a cooling bar with variable positioning of the partition walls and the effect of the displacement of the partition walls on the distribution of the volume flow of the coolant over the width of the metallic product.

Finally, FIG. 5 shows an exemplary embodiment of the present invention, in which the partition walls 140 can be moved in the longitudinal direction of the cooling bar 110. As can be seen in the lower illustration of FIG. 5, a movement of the partition walls 140 causes a shift in the starting time for the beginning of a degressive course of the coolant distribution. Specifically, in the exemplary embodiment shown in FIG. 5, the right and left partition walls 140 are each moved outwards (see dashed line); as a result, also the starting times for the degressive decrease in the coolant volume flow on the right and left are shifted outwardly, i.e. towards the edges of the metallic product.

LIST OF REFERENCE DESIGNATIONS

100 cooling device
110 cooling bars
120 valves
130 spray nozzles
140 partition walls
144 Actuating elements for positioning the partition walls
150 control device
160 pump
200 metallic product
300 coolant
400 cooling model
I, II, III spraying regions
L, x longitudinal direction of the cooling bar
M center of the metallic product
n, N number of spraying regions
T, Y direction of transport of the metallic product
Temp temperature (distribution)
$\Delta Y1$, $\Delta Y2$ width sections

What is claimed is:

1. A cooling device for cooling a metallic product, comprising:

a tubular cooling bar with a plurality of spraying regions arranged adjacent in pairs, each of the plurality of spraying regions having at least one spray nozzle for spraying a coolant on the metallic product;

a plurality of valves arranged for individually adjusting at least one of a pressure or a volume flow of the coolant in each of the plurality of spraying regions;

a control device arranged for individually controlling the plurality of valves;

a temperature measuring device arranged for determining distribution of temperature along a width of the metallic product before the metallic product enters the cooling device;

one or more partition walls arranged within and configured to divide an interior portion of the tubular cooling bar into at least two chambers of a predetermined arrangement, each of the plurality of spraying regions corresponding to a different one of the at least two chambers;

each of the one or more partition walls being shaped at least approximately in accordance with a corresponding predetermined width section defined by the distribution of temperature along the width of the metallic product before the metallic product enters the cooling device; and wherein the one or more partition walls are arranged in the interior portion of the tubular cooling bar over the corresponding predetermined width section of the metallic product, wherein at least one adjusting element, which is controllable by the control device, is provided for variable positioning of the one or more partition walls within the interior portion of the tubular cooling bar, in which the one or more partition walls are selectively moved in a longitudinal direction of the tubular cooling bar to change from the predetermined arrangement of the at least two chambers defining the plurality of spraying regions of the tubular cooling bar to a new arrangement of the at least two chambers defining the plurality of spraying regions of the tubular cooling bar.

2. The cooling device according to claim 1, wherein at least one of the plurality of spraying regions has a plurality of spray nozzles distributed in x and y directions with respect to the longitudinal direction (L) of the tubular cooling bar.

3. The cooling device according to claim 1, wherein an arrangement and/or number of the at least one spray nozzle in the plurality of spraying regions of the tubular cooling bar is symmetrical in a width direction in relation to a central axis of the metallic product.

4. The cooling device according to claim 1, wherein the one or more partition walls run between the at least one spray nozzles of adjacent ones of the plurality of spraying regions.

5. The cooling device according to claim 1, wherein the one or more partition walls are at least one of straight, step-shaped or curved.

6. The cooling device according to claim 1, wherein the at least two chambers within the tubular cooling bar is three or more chambers.

7. The cooling device according to claim 6, wherein the at least two chambers is three chambers which define a left spraying region, a middle spraying region, and a right spraying region, and wherein each spraying region is trapezoidal in shape.

8. The cooling device according to claim 1, wherein a plurality of tubular cooling bars are arranged in parallel.

9. The cooling device according to claim 1, wherein the control device is a pilot control arranged for setting of the plurality of valves and/or actuators which position the one or more partition walls with respect to a calculated setpoint distribution for the coolant over the metallic product.

10. The cooling device according to claim 1, wherein the control device is a control loop that controls an actual distribution of the volume flow or the pressure of the coolant to a predetermined target distribution of the volume flow or the pressure of the coolant over the metallic product by suitable variable control of at least one of the plurality of valves or actuators for positioning of the one or more partition walls within the tubular cooling bar.

11. The cooling device according to claim 9, wherein a cooling model is provided for calculating a target setpoint distribution for the at least one of the pressure or the volume flow of the coolant over the width of the metallic product.

12. The cooling device according to claim 11, wherein the cooling model provided to calculate the target setpoint distribution of the coolant over the metallic product is a function of one or more measured variables supplied to the cooling model, including:

the temperature or a temperature profile of the metallic product along at least one of a length direction or a width direction at a location of an entrance and/or an exit of the cooling device;

an actual property of the metallic product including at least one of a hardness, a toughness, or a retained austenite content at the exit of the cooling device; and/or a temperature of the coolant when spraying onto the metallic product.

13. The cooling device according to claim 1 wherein a quantity of the plurality of spraying regions is selected as a function of a desired coolant exposure density.

14. A method for operating the cooling device according to claim 1, wherein the one or more partition walls between two adjacent spraying regions are moved in the longitudinal direction of the tubular cooling bar to correspond with a temperature distribution over the width of the metallic product before entering the cooling device or to set a desired target distribution of the pressure or the volume flow of the coolant over the width of the metallic product.

15. The method according to claim 14, wherein the one or more partition walls on both sides of a central axis of the tubular cooling bar are moved symmetrically with respect to the central axis of the tubular cooling bar.

16. The method according to claim 14, wherein the one or more partition walls are moved during an ongoing cooling operation.

17. The cooling device according to claim 1, wherein at least one of the plurality of spraying regions has a plurality of spray nozzles distributed along parallel rows in the longitudinal direction of the tubular cooling bar.

18. The cooling device according to claim 1, wherein at least one of an arrangement or number of the at least one spray nozzle in the plurality of spraying regions of the tubular cooling bar is asymmetrical in a width direction in relation to a central axis of the metallic product.

19. The method according to claim 14, wherein the one or more partition walls on both sides of a central axis of the tubular cooling bar are moved asymmetrically with respect to the central axis of the tubular cooling bar.

20. The cooling device according to claim 1 wherein a quantity of spray nozzles per unit area of the plurality of spraying regions is selected as a function of a desired coolant exposure density.

* * * * *